United States Patent [19]

Seimiya et al.

[11] 4,320,952

[45] Mar. 23, 1982

[54] SHEET TRANSPORT IN ELECTROPHOTOGRAPHIC COPYING APPARATUS

[75] Inventors: Ryubun Seimiya; Akira Shinozaki; Isao Nosaka; Fumio Iwai, all of Hachioji, Japan

[73] Assignee: Konishiroku Photo Industry Co., Ltd., Tokyo, Japan

[21] Appl. No.: 1,061

[22] Filed: Jan. 5, 1979

[30] Foreign Application Priority Data

Jan. 17, 1978 [JP] Japan ..... 53/4097

[51] Int. Cl.[3] ..... G03G 15/00

[52] U.S. Cl. ..... 355/3 SH; 219/216; 355/3 FU

[58] Field of Search ..... 355/3 R, 3 FU, 3 TR, 355/8, 14 FU, 3 SH, 14 SH; 219/216, 388 W

[56] References Cited

U.S. PATENT DOCUMENTS 4,005,933 2/1977 Loye et al. ..... 355/8 X 4,081,213 3/1978 Bar-on et al. ..... 219/216 X 4,141,545 2/1979 Schnall et al. ..... 355/8 X 4,162,847 7/1979 Brandon ..... 219/216 X 4,163,893 8/1979 Turin ..... 219/216

*Primary Examiner*—Richard L. Moses

*Attorney, Agent, or Firm*—Bierman & Bierman

[57] ABSTRACT

In a transfer type electrophotographic copying apparatus having a rotatable photosensitive drum for receiving an electrostatic latent image of an original and a heating device comprising a heating roller and a pressure-contact roller rotatable in a condition of pressure-contact with the heating roller for fixing a toner image of the original on a transfer paper moved along a path including a position of image transfer contact with the drum and then between the rollers, the distance from the contact position of the transfer paper with the drum to the pressure-contact point of the heating and pressure-contact rollers being less than the length of the transfer paper as measured in the direction of movement of the paper along the path.

4 Claims, 15 Drawing Figures

SHEET TRANSPORT IN ELECTROPHOTOGRAPHIC COPYING APPARATUS

FIELD OF THE INVENTION

The present invention relates to a transfer type electrophotographic copying apparatus.

BACKGROUND OF THE INVENTION

It is well known that, in recent years, electrophotographic copying apparatus have come to have a large share of the field of business machines. Although there are differences among various machines in copying speed—owing to the convenience of utilizing plain paper as copy sheets as well as low unit copy costs—transfer type electrophotographic copying apparatus have come to a position of importance in the mainstream of the business machine field.

Such copying machines have drawbacks such as the typically large size of the apparatus and, in addition, their mechanisms are generally complex. Furthermore, where it is possible to use only several kinds of transfer papers—as, for example, transfer papers of B4 size, A4 size and B5 size—drawbacks arise such as in the copying of relatively oversize design diagrams (utilization of which has been remarkably increased in recent years) of A3 size whereby it is necessary to rely on other copying machines; likewise where the size of the original to be copied is small (such as of B6 size), whereby the transfer paper is wastefully consumed.

Moreover, in the conventional copying apparatus provided with a drum-shaped sensitive member and a roller type fixing device as a settling or fixing means, it has been impossible to construct the apparatus so that the distance between the sensitive drum and a pair of rollers constituting the fixing means is shorter than the length in the moving direction of the transfer paper, and, as a result, the size of the apparatus is larger than desired.

In the present invention, the above-mentioned drawbacks are eliminated.

SUMMARY OF THE INVENTION

A principal object of the present invention is to provide an improved electrophotographic copying apparatus or device.

Another object of the present invention is to provide a copying apparatus in which the distance between a jointless or demand type drum having a photoconductive layer thereon and a roller type fixing device is set so that it is shorter than the length in the carrying or moving direction of the transfer paper to be used.

BRIEF DESCRIPTION OF THE DRAWINGS

In the Drawings, wherein like reference numerals denote similar elements throughout the several views.

DETAILED DESCRIPTION OF THE PREFERRED EMBODIMENT

Figure 1:
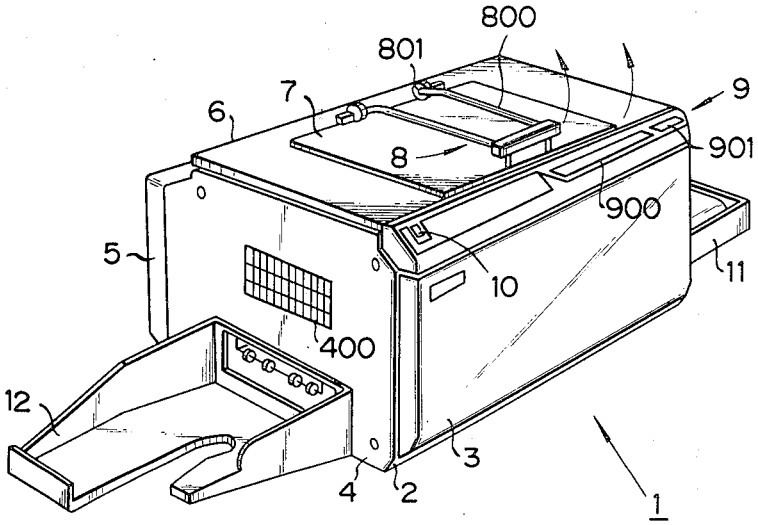
FIG. 1 is an elevated perspective view showing the exterior appearance of an apparatus constructed in accordance with the teachings of the present invention.
Figure 2:
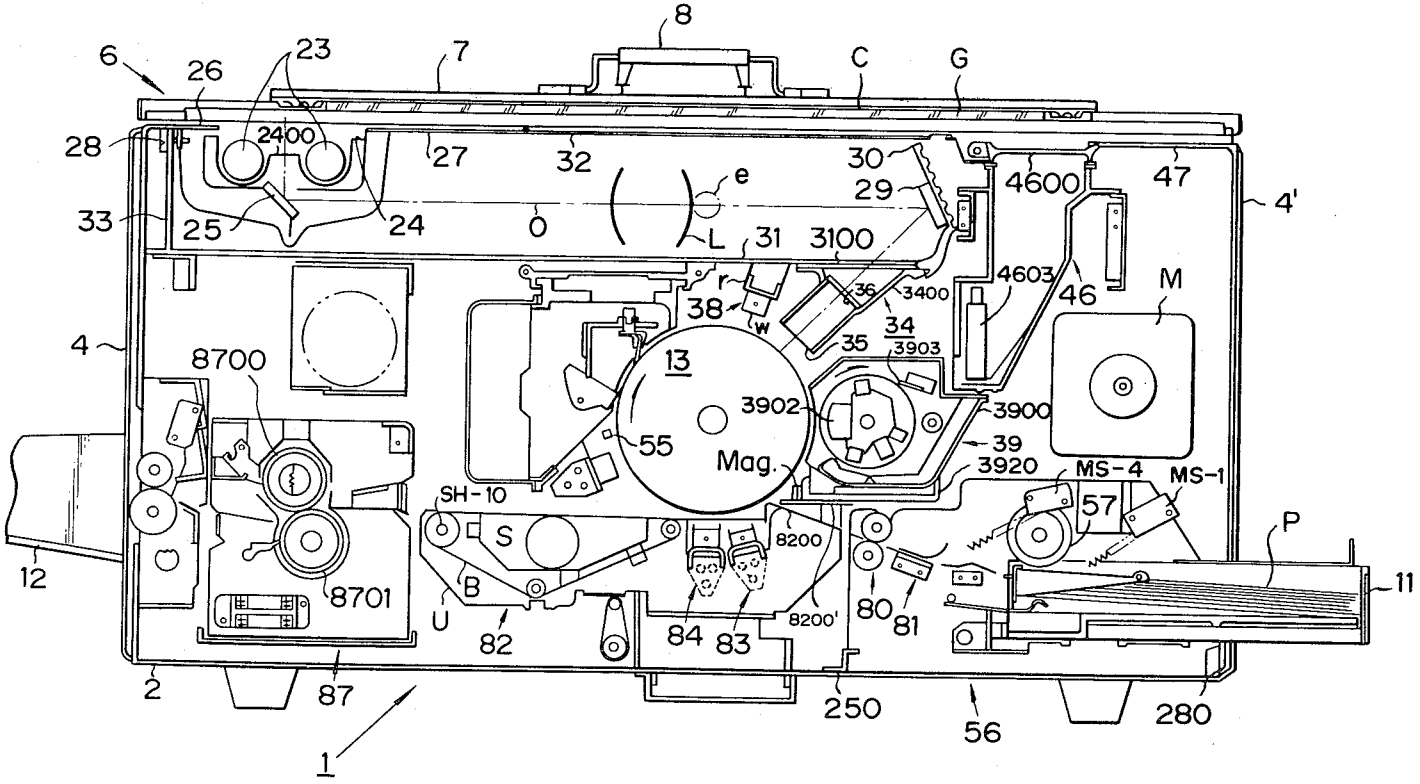
FIG. 2 is a schematic view showing the interior arrangement of the apparatus according to the present invention.

FIG. 1 is a view of the exterior appearance of an electrophotographic copying apparatus in which a copy board for receiving an original to be copied is reciprocally movable. In the drawing, reference numeral 1 denotes the copying apparatus generally, 2 indicates a bottom plate, and 3 denotes a front door which is capable of turning about a lower fulcrum in a well known manner. Reference numeral 4 denotes a left side cover, 400 denotes an exhaust air hole or window, and 5 denotes a rear side cover. A right side cover 4' is disposed on the side opposite the left side cover 4 as shown in FIG. 2.

Reference numeral 6 denotes a copy board, 7 denotes a platen cover, and 8 denotes a handle for opening and closing said platen cover 7. The reference numeral 800 denotes a supporting pillar provided in relation to the handle 8 and a control member 801 is secured to the copy board. When the handle 8 is turned in the direction indicated by an arrow in FIG. 1, the control member 801 stops the platen cover 7 at a substantially predetermined position and, thereafter, continuously maintains the opened condition or state of the platen cover. Reference numeral 9 denotes an operating portion of the apparatus and comprises a region 900 provided with a 10-key board for indicating or representing a particular copying condition, or a zero paper condition, or a paper clogging or jamming condition, and for setting the number of copies; it further includes an indicating means and a clearing key and a region 901 having a copying button.

In a manner not indicated in FIG. 1, by appropriately pressing on the 10-key keyboard, the above-mentioned indicating means is able to represent up to a maximum number of 99 sheets of papers. The paper setting number can of course be changed even in the course of a copying operation. Furthermore, the copying button is divided and/or separated into three portions so that a high quality picture image can always be obtained by selecting the bias voltage value to be impressed on a well-known magnetic brush device 39 shown in FIG. 2, the bias voltage being selected in accordance with the density of the original to be copied, or based upon whether the color thereof is white or black. The reference numeral 10 shown in FIG. 1 at a position spaced from the operating portion 9 denotes a main switch. The reference numeral 11 denotes a cassette for containing a plurality of transfer papers therein—as, for example, of A3, B4, A4, B5 and B6 sizes. Reference number 12 denotes a tray.

Figure 3:
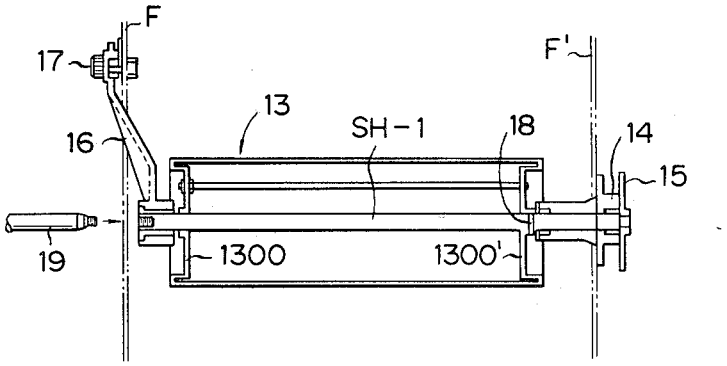
FIG. 3 shows the manner in which the photosensitive drum is mounted on the apparatus.

Moreover, it should be understood that the front door 3, rear side cover 5, and right and left side covers 4 and 4' are respectively related to plate-shaped frames F, F' fixed to the bottom plate 2 by soldering; as shown in FIG. 3, the frames are arranged on the front and rear sides and parallel to each other in FIG. 1. In view of the generation of loosening vibrations and the mechanical strength of the screws when they are fixed to the bottom plate by means of the screws, the frames are rigidly soldered to the bottom plate.

I. Construction and Arrangement of Respective Portions

FIG. 2 is a schematic view showing the interior construction and arrangement of the apparatus depicted in FIG. 1. In FIG. 2, the same parts as those seen in FIG. 1 are also represented with the same reference numerals.

Reference numeral 13 denotes seam lessor demand type photosensitive drum formed by steam fusion bonding a light conductive layer composed of a selenium-tellurium onto a hollow aluminum cylindrical surface. The drum 13 is directly connected to a main motor M so that it is capable of rotation in the direction indicated by an arrow. The drum 13 is, as shown in FIG. 3, held on a shaft SH-1 extending through frame F' mounted at the rear (right side in the drawing) of the apparatus. Reference numeral 14 denotes a bearing mounted on frame F' so as to rotatably support the drum shaft SH-1, while numeral 15 denotes a gear mounted on the same shaft. The drum shaft SH-1 is directly connected to the main motor.

Reference numeral 16 denotes an arm for holding one side of the drum shaft SH-1, and one of its ends is secured by a screw 17 to frame F disposed at the front (left side in the drawing) of the apparatus. Numeral 18 denotes a pin for confirming the connection or coupling between the photosensitive drum 13 and the shaft SH-1, and for additionally imparting a torque to the drum during copying operations. A rim portion 1300 of drum 13 includes a groove for engagement with the pin 18.

It will be understood from the foregoing that the drum 13 is detachable with respect to the shaft SH-1. A female screw (no reference numeral) is provided on the side of the arm 16 of the shaft SH-1. When the drum 13 is mounted on the shaft SH-1, or when the drum is dismounted from the shaft, the surface of the drum 13 or other members disposed around the drum are apt to be damaged. In order to prevent such damage, an auxiliary bar 19 is engageable with the female screw so as to aid in drum movement.

The symbol G denotes a copy board surface, composed of a transparent glass, and provided at the lower side of the platen cover 7. The copy board 6 is reciprocally controlled by a known method. Furthermore, the moving distance of the copy board 6 can be varied in accordance with the size of the transfer paper to be used. Regulating or restricting signals for setting the moving distance of the copy board and defined as respective transfer paper size detecting signals are provided by a plurality of microswitches MS-1, MS-2, and MS-3 (FIG. 13) arranged in the main body of the apparatus in operative relation to the cassette 11.

Almost all processes of the apparatus are controlled by a microcomputer (not shown) and, as a consequence, the operations based upon these timing signals are determined by one among several time charts stored in the microcomputer. Orders or indications from the microcomputers for the respective processes are based on a phase detecting disc mounted on the supporting shaft SH-1 of drum 13. That is, a large number of slits 2000 are formed around the phrase detecting disc and, when the disc rotates during a copying operation, the number of passing slits is counted—as by illuminating elements such as a luminous diode 21 and a light receiving element such as a phototransistor; the respective processes are successively controlled in accordance with the number of slits counted. In practice, the number of said slits 2000 is defined as 180, although it is not of course necessary to so limit the number.

Reference numeral 23 denotes an exposure or exposing lamp consisting of a pair of fluorescent lamps. The exposure lamp 23 is maintained or held by a frame (reflection plate) 24 and is detachable with respect to the main body of the apparatus.

The inner surface of frame member 24 is shaped so that the luminous light from exposure lamp 23 converges on the surface G of the copy board. Slit openings are formed in an inner surface 2400 of frame member 24 projecting between the two exposure lamps 23. The above-mentioned projecting portion is provided for the purpose of preventing the invasion of extraneous or irregular or miscellaneous light into the optical system.

The fluorescent exposure lamp 23 is provided with a projection aperture 2402 formed on the tube wall of, for example, such as so-called aperture-type or reflection-type fluorescent lamp so that a required amount illumination can be obtained with relatively little energy consumption. However, the intensity of illumination is susceptible to atmospheric temperature; when the tube wall temperature is 40° C., a maximum illumination intensity is obtained. The light intensity at temperatures higher or lower than 40° C. decreases and, particularly at temperatures lower than 20° C., remarkably decreases. Accordingly, if the copying operation is carried out under such a condition, photographic fog is apt to be produced due to an insufficient amount of light. In order to obtain a picture quality of allowable range, it has been experimentally found necessary to maintain the tube temperature of the fluorescent lamp in a range of at least 20° to 25° C.

Reference numeral 25 denotes a first mirror disposed at a position just below the projecting portion 2400 (hereinafter referred to as slit portion 2400) with a predetermined inclination with respect to an optical axis 0. A supporting plate (not shown) of the first mirror 25, and the frame 24, are mounted on plates 26 and 27, respectively, so that they are capable of moving together as one body in the left and right directions during assembly. The symbol L denotes a lens, reference numeral 29 represents a second mirror, and 30 denotes a supporting plate for supporting the second mirror and for preventing the intrusion of miscellaneous or extraneous light. The reference numeral 31 represents a lower plate disposed at a position below the optical system composed of the first mirror 25 (including the exposure lamp 23), the lens L and the second mirror 29, and provided with an aperature 3100. Reference numeral 23 denotes an upper plate, while 33 denotes a side plate.

From the above-described construction, it will be understood that the optical system is shielded from the remainder of the apparatus and its exterior by means of the upper plate 32, the lower plate 31, side plates, and the supporting plate 30, so that introduction of the light based on the illumination of exposure lamps 23 and reflected from an original C to be copied onto the drum 13 is not hindered.

Figure 4:
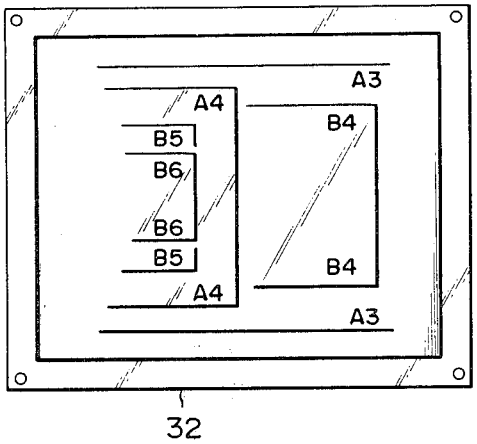
FIG. 4 shows an upper plate having indicating lines for variously-sized originals to be copied.

The upper plate 32 can be detachable from the apparatus when necessary—as, for example, to clean the second mirror 29 and the like—and can be provided on the upper surface thereof with several parallel indicating lines showing the positions for variously sized originals (FIG. 4).

Reference numeral 34 denotes a slit box consisting of a luminous amount adjusting member for controlling the luminous amount reflected from the second mirror toward the drum 13, a dust proof member 36 composed of a transparent glass which faces the member 35 across an air gap, and a black-colored frame member 3400 obtained by resinous molding. The slit box 34 is detachable from an engaging portion utilizing the lower portion of lower plate 31 and the supporting plate 30.

Figure 5A:
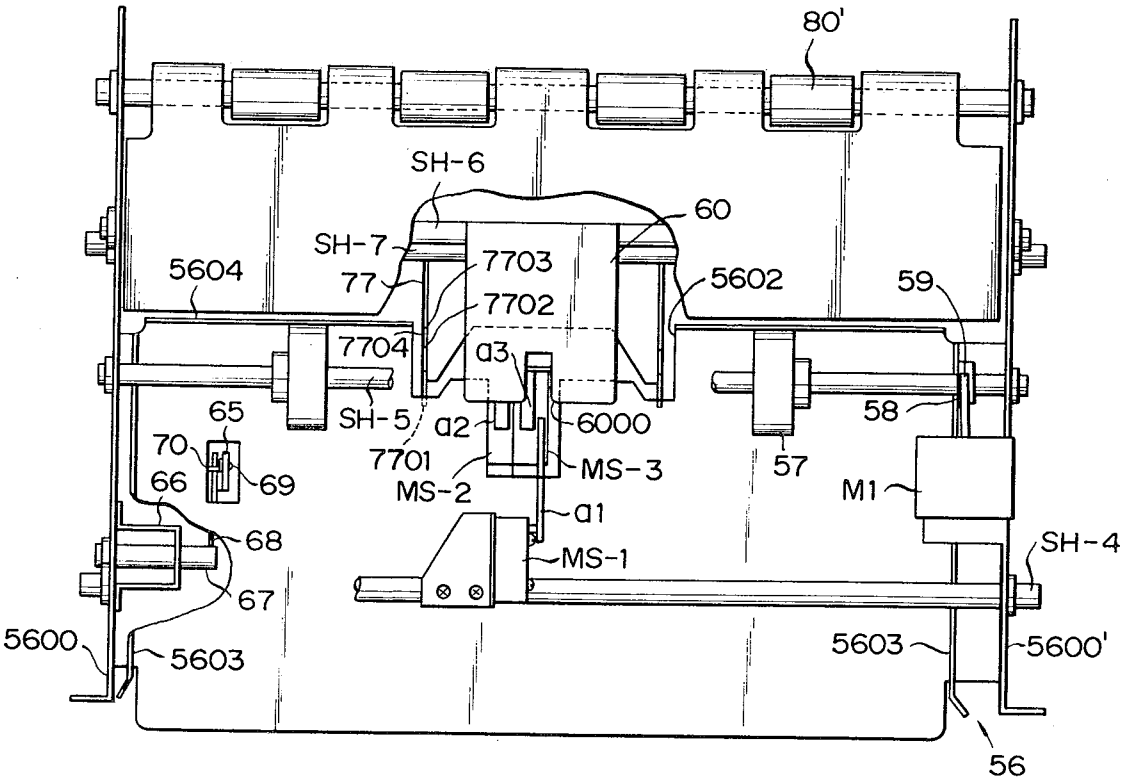
FIG. 5A is a plan view of the paper feed device.
Figure 5B:
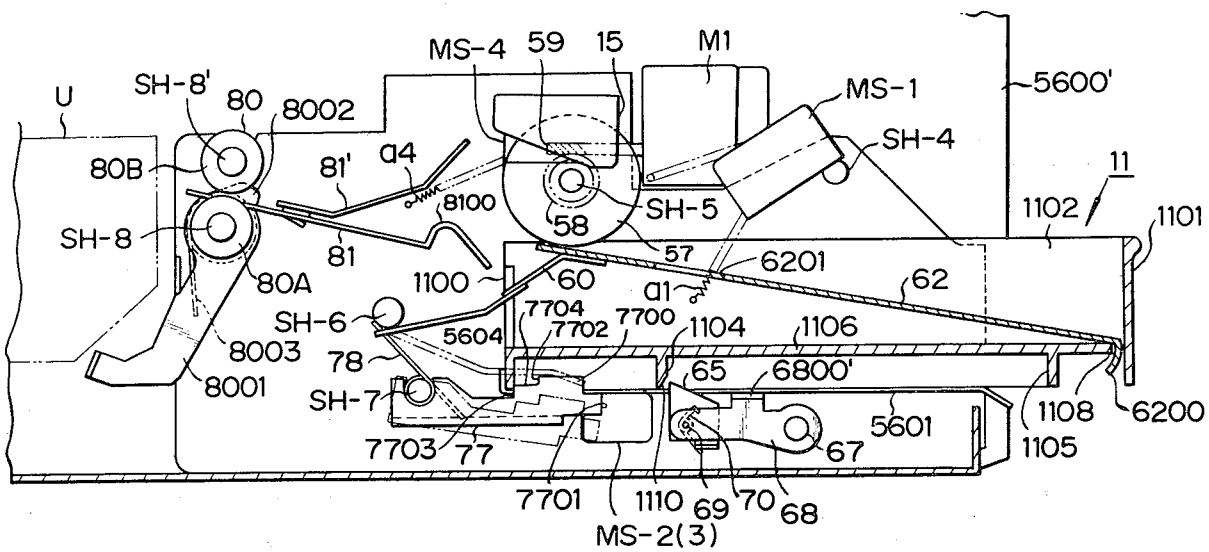
FIG. 5B is a longitudinal sectional view showing the interior thereof.

Next, a paper feed or feeding device 56 and the cassette 11 are explained with reference to FIG. 5. FIG. 5A is a plan view, partially cut away, of the paper feed device, and FIG. 5B is a longitudinal sectional view showing the inside thereof. In the drawings, reference numerals 5600 and 5600' indicate left and right side plates, respectively. In addition, the paper feed device 56 of this embodiment provides a paper feed or feeding roller 57 at a stationary position, and a method for raising transfer papers P from a decreasing stack thereof during the copying operation is employed. The reference numeral 5601 denotes a placing or mounting table for receiving the cassette 11 (FIG. 5B) and which is provided with a cut portion 5602 at its front central portion. Furthermore, rising portions 5603, 5603' and 5604 are provided at its side and front ends.

The microswitch MS-1 for detecting the presence of the transfer papers contained in the cassette 11 is rigidly mounted on a shaft SH-4 rotatably supported by side plates 5600 and 5600', so that it is positioned at the central upper portion of the placing table 5601. Microswitches MS-2 and MS-3 are located at the lower side of the placing table 5601. Actuators a2 and a3 of the microswitches MS-2 and MS-3, respectively, are positioned so that they project upwardly from the placing table 5601 from a part of the cut portion 5602. The actuators a2 and a3 are energized by the cassette; that is, when the cassette is positioned on the placing table, a portion for energizing at least one of the actuators a2 and a3 of the microswitches MS-2 and MS-3 is provided at a location on the cassette 11 corresponding to the size of the transfer paper. On the assumption that an actuator a1 of the microswitch MS-1 is energized by the presence of paper, and the microswitches MS-2 and MS-3 are energized or not in various combinations, these microswitches can detect 5 kinds or sizes of transfer papers as shown in the following table.

| TRANSFERRING PAPER SIZE | MICROSWITCH | | |
|---|---|---|---|
| | MS-1 | MS-2 | MS-3 |
| A3 | O | X | O |
| A4 | O | X | X |
| B5 | | | |
| B4 | O | O | O |
| B6 | O | X | X |

As earlier mentioned, the signal for detecting the transfer paper size selects one of the time-charts corresponding to the particular size of the transfer paper and stored or memorized at a ROM (Read Only Memory) section of the microcomputer. Of course, the apparatus may be constructed so that the detecting signal energizes a transfer paper size representing means.

The paper feed roller 57 is rotatably mounted on a shaft SH-5 rotatably supported between the side plates. A worm wheel is mounted on the right hand side of shaft SH-5 (FIG. 5B), and the worm wheel meshes with a worm 59 mounted on the output shaft of a paper feeding motor M1 operated in accordance with the copying operation.

Reference numeral 60 denotes a pressing plate mounted on a rotatable shaft SH-6 and positioned at the upper portion of the front end central portion of the placing table 5601. The pressing plate is constructed so that it moves interlinked with a cam lever 61 through a shaft SH-6. The tip end portion of the pressing plate 60 is separated at its right and left hand sides by a cut portion 6000 formed therebetween. When the cam lever 61 is pushed up, the tip end portion of pressing plate 60 is maintained at a first position substantially parallel to the placing table. This first position is such that the tip end portion of the pressing plate is capable of engaging with or being inserted into a space formed by a bottom plane 1107 of the cassette and a sheet receiving plate or board 62 when the cassette 11 is slid along the placing table 5601. In addition, when a leg portion 1104 provided at the bottom portion of the cassette 11 pushes down a detection or detecting projector 65 projecting from another hole 5605 formed in the placing table in the mid course of its sliding movement, the pressing plate 60 is elevated through the rotatable shaft SH-6 by a mechanical force to a second position and is there maintained. In this condition, the pressing plate 60 elevates the sheet receiving board 62 in the cassette 11 and, accordingly, the uppermost paper of the accumulated or stacked transfer papers P contained in the cassette C is pressure-contacted with the paper feed roller 57.

Referring to FIG. 5B, a rotatable pin 67 is rotatably supported by side plate 5600 and a substantially U-shaped holding member 66. An arm 68 is fixed on the pin 67, and the detecting projector 65 is rotatably mounted on a lateral pin 69 mounted on the arm 68. Moreover, the detecting projector 65 is controlled or urged in the clockwise direction in FIG. 5B by spring to and maintained in a condition facing the arm 68. Consequently, when the detecting projector 65 is pushed down by the leg portion 1104 of the cassette to be slid toward a loading position, the arm 68 is moved through an engaging portion, and, in accordance with this movement of the arm, the rotatable pin 67 is likewise moved and the rising position engagement of the cam lever 61 is released. However, when the cassette is retracted from the loading position, the leg portion 1104 of the cassette 11 turns only the detecting projector 65 against spring 70, and the arm 68 and the pin 67 are not actuated; after passing the leg portion 1104, the detecting projector 65 returns to its initial position.

The paper feed device 56 is engaged at its front end with an engaging member 250 disposed on the bottom plate 2 as shown in FIG. 2, and its rear end is fastened to a rising portion 280 by means of a screw. On the right hand side cover 4' there is formed a recess portion so as to position a handle portion H at its outside and, in addition, a lengthwisely long opening so as to allow the up and down motions of the cam lever 61. Accordingly, when the paper feeding device and right hand side cover 4' are mounted on the main body of the apparatus, only the handle H is exposed. Furthermore, the method of attachment of the paper feeding device 61 is very simple as mentioned above, and the cover can be easily attached to the main body of cramp screws or the like; thus, on the occurrence of some fault or trouble or damage to the members, the member can be promptly dismounted from and/or remounted onto the main body.

A carrying means 82 is now described. Carrying means 82 includes a guide plate 8200 for guiding the transfer papers P being moved into contact with the image region of the sensitive drum 13 by means of the first carrying roller 80 of the paper feeding device and toward a transfer electrode 83 and an electric charge removing device 84. The electrode 83 effects transfer of the toner picture image on the sensitive drum onto the transfer paper; the electric charge removing device 84 removes electric charges from the transfer papers and is connected to an AC source so as to enable separation from the drum 13 of the transfer paper moving with the sensitive drum in an electrostatic adhesive condition therewith.

Figure 6:
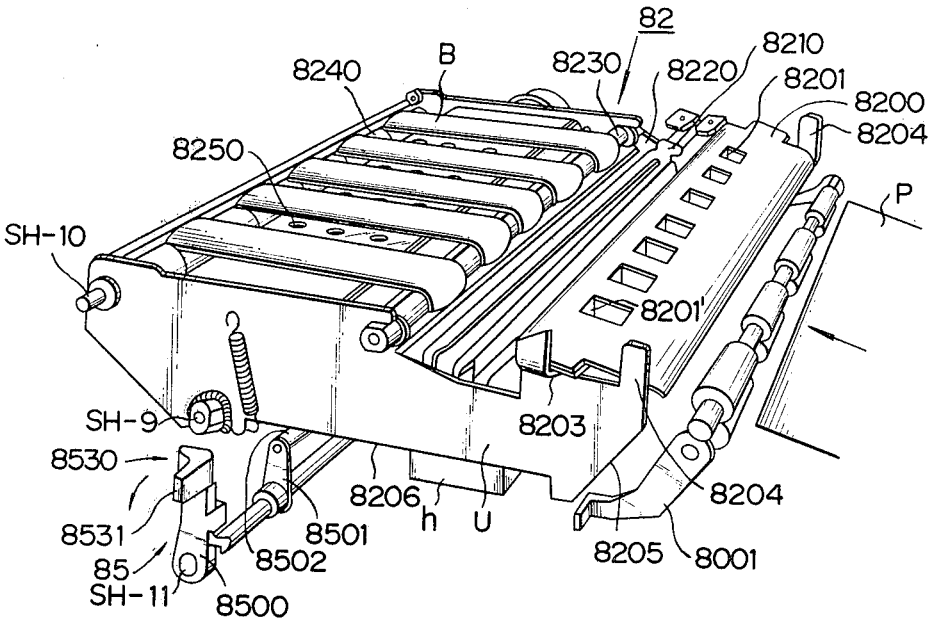
FIG. 6 shows a paper carrying assembly.

Reference is now made to FIG. 6 showing the paper feeding or carrying means 82. Symbol B denotes a conveyor belt, S denotes a suction box connected to a suction means (not shown), and reference symbol U denotes a holding member for holding the respective members. At its right side upper portion, there is formed a bent portion 8203 having a predetermined area, and a guide plate 8200 is rigidly mounted on the bent portion. An end portion 8204 projecting from the furthermost right hand side of the holding member U makes contact with a part of an upper side guide plate 8200'—provided at the bottom portion of a holding member 3920 of developing device 39—when carrying means 82 is situated at its normal position seen in FIG. 2. In FIG. 2, the end portion 8204 is shown as a line extending from a part of the lower side guide plate 8200. The reference symbol "Mag." indicates a magnet provided on the upper side guide plate 8200' for gathering developing agent that falls to that position. A plurality of openings 8201 formed on guide plate 8200 are used for detecting and preventing the dropping of water from the surface of the sensitive drum, or water contained in the developing agent and provided with respect to other elements so as to insure the ability to always obtain a normal copy picture image. The position and shape of the openings 8202 are suitably defined so as lead heat from a heating source shown by the reference symbol h to the developing device 39 and at least to the surface of the sensitive drum 13 facing the device. The reference numeral 8201' represents a means for performing the above-mentioned object or purpose—that is, for dropping punched plates and distributing the heat to the sensitive drum side and the developing device side. The heat from the heating source may, for example, be blown by a small fan. Reference numerals 8210 and 8220 represent levers for mounting the transfer electrode 83 and removing device 84, respectively.

The symbol B denotes a conveyer belt mounted around rollers 8230, 8240 and a roller having a shaft SH-9 (only the shaft is shown). On the upper plate of the suction box there is formed a hole 8250 of suitable shape and size. This hole is used for sucking the transfer papers P which have passed through the image transfer process onto the belt B, and thereby securing the transferring or carrying operation. Driving of the belt B can be effected by connecting one of its plurality of rollers to the driving system. In addition, the holding member U comprising various members as one body is capable of turning about a supporting shaft SH-10 of the roller 8240 in the direction indicated by an arrow.

The degree to which the holding member U turns can be optionally determined by a pertinent mechanism. When a right side end portion 8205 of the holding member U falls down while turning, a lever 8001 mounted on the paper feeding device 56 is turned in a counterclockwise direction. At this time, a space is formed between the pair of first carrying rollers. The reference numeral 85 represents an entire lever device for maintaining the holding member U at a predetermined position and for causing the holding member U to fall down while turning. Reference numeral 8500 represents an operating lever engaged with a shaft SH-11. An arm 8501 mounted on the shaft SH-11 is disposed at a position inside of the operating lever 8500. The respective members of the holding member U are eventually situated at respective predetermined positions by a rod 8502 mounted on the free end portion of arm 8501. The falling down of the holding member is effected by the turning motion of operating lever 8500 in the direction shown by an arrow.

In FIG. 7, reference numeral 87 represents a roller type fixing device for supplying heat to the transfer papers P carrying the toner picture images so as to melt the toner on the transfer paper. Numeral 8700 denotes a heating roller having a heating element consisting, for example, of a halogen lamp provided at the inside thereof. The surface of the roller type fixing device 8700 is covered with a resinous material—as for example tetrafluoroethylene—having a good separation or separating property with respect to the toner. Reference numeral 8701 represents a pressing roller mounted so that it is capable of rotating together with the heating roller 8700 with a predetermined contact pressure therebetween. The surface of the pressing roller 8701 may, for example, be covered with a silicon resin. In addition, the distance between a contact or nip portion of the rollers and a point which is obtained on the carrying passage of the transfer papers P when the center line of the drum and the transfer electrode are linked by a phantom line, is set so that said distance is shorter than the length in the transferring direction of the transfer papers to be used; thus, the size of the apparatus can be advantageously minimized.

The apparatus of the embodiment is constructed so as to use transfer papers of sizes of A3, B4, A4, B5 and B6, as previously mentioned. (As should be apparent from FIG. 4, transfer papers of B4 size are fed lengthwisely.) The said distance is the same as the length of B4 size. As a consequence, with respect to transfer papers of A4, B4 and B5 size, the above-mentioned expression is not appropriate. However, in the disclosed embodiment, it is equally apparent that the said distance between the rollers and the point described above is shorter than the length in the transferring direction of the transfer papers of A3 size. This means, for example, that when an exclusive device in accordance with the size of the transfer paper is assumed, the aforementioned setting condition is effective, and the same effect can be obtained and, accordingly, such an expression is used.

The heating roller 8700 and pressing roller 8701 are controlled so that these rollers normally maintain a space therebetween and, in addition, maintain a non-rotational condition, even when the main switch 10 (FIG. 1) is turned ON; when the print button is depressed, however, these rollers commence to rotate and are moved into a pressure-contact condition.

Moreover, when the main switch is ON, heating element 8702 is electrically and operatively connected. The construction of its relationship is now explained using FIG. 7.

Figure 7A:
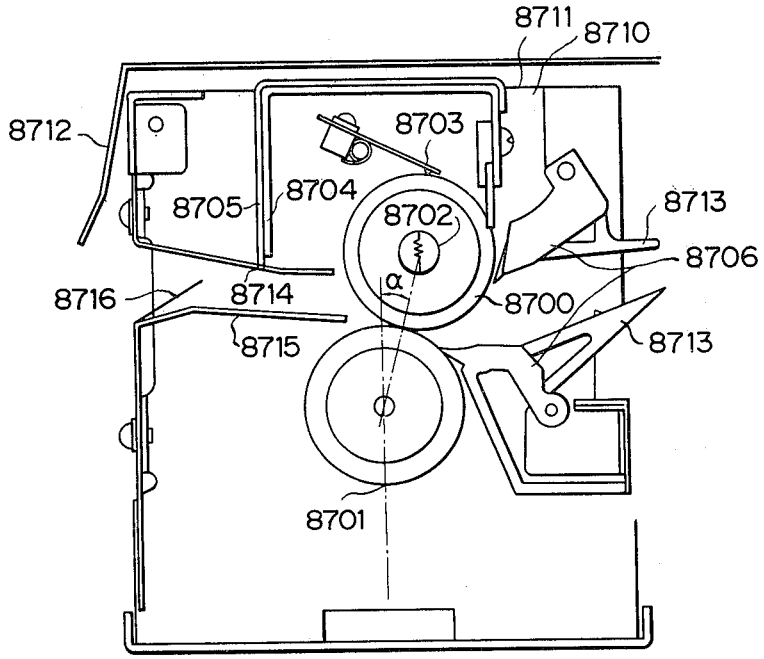
FIG. 7A is a sectional view of a roller type fixing device.
Figure 7B:
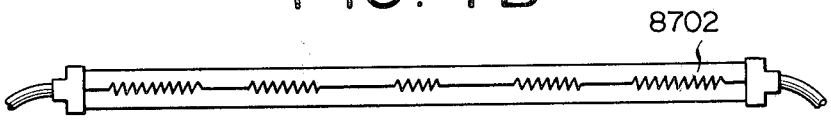
FIG. 7B shows a heating element thereof.
Figure 7C:
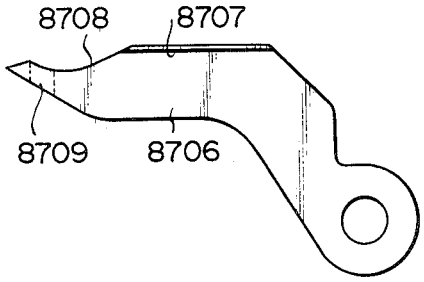
FIGS. 7C and 7D show a separating claw thereof.
Figure 7D:
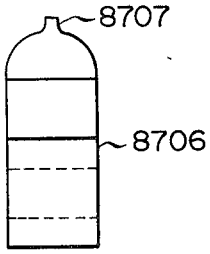

The filament of the heating element 8702 is segmentally constructed as shown in FIG. 7B. The heating capacity of the heating roller is such that its heating capacity at the end portion sides is large with respect to that of the central portion of the heating roller. In addition, the heating capacity of the end portion is defined so that the heating capacity of the end portion side being connected to the driving source is larger than that of the other or opposite end portion side.

Reference numeral 8703 represents a temperature detecting element disposed close to the back face of heating roller 8700. The numeral 8704 denotes a reflection mirror, for example of aluminum, subjected to a surface polishing treatment on its inner face. Of course, it is possible to use a reflection mirror which is not subjected to the surface polishing treatment. Reference numeral 8705 denotes an adiabatic material or member mounted on the outside of the reflection mirror. The parts 8704 and 8705 are mounted so as to cover the heating roller 8700; this arrangement protects against mistaken or erroneous measurements by the temperature detecting element 8703 due to air or wind currents entering from, for example, the right or paper exhaust side of the machine exterior.

Reference numeral 8706 represents upper and lower separation or separating ratchets, the tip ends of which contact a part of the peripheral surfaces of the heating roller 8700 and pressing roller 8701, respectively. In the drawing, only the upper side separation ratchet is shown together with the holding member. In consideration of mechanical strength high temperature characteristics, separation property with respect to toners, and accurate formation of the separation ratchet tip end, the separation ratchet is constructed of a polyphenylenesulfide containing a teflon by weight of from 2 to 40%—and, most preferably, by weight of from 5 to 25%. Furthermore, a portion 8707 thereof which may make contact with the transfer papers after fixing is provided with a narrow projection. The Reference numeral 8708 denotes a recess portion for accumulating toner particles which have not been perfectly fixed, and 8709 indicates a hole for storing or containing toner which may be so accumulated.

Numeral 8710 represents an opening formed at the upper portion of a frame member 8711 which is used for shifting the wind or air currents—entering from the apparatus exterior (i.e. the right hand side in FIG. 7A)—along the reflection mirror 8704 and then discharging the air out of the apparatus. Reference numeral 8712 denotes a regulation plate for controlling the wind or air currents discharged from the opening, and for leading the wind to a portion where undesirable influences are not imparted to the temperature detecting element 8703. The numeral 8713 represents paper exhaust guides.

The center of the heating roller 8700 and the center of the pressing roller 8701 are not positioned on a vertical plane, the heating roller 8700 being shifted toward the exhaust paper side with respect to the pressing roller 8701. In the disclosed embodiment, the angle between an imaginary line connecting the centers of the two rollers and a vertical line passing the center of the pressing roller 8701 is set at about 15°. The heating roller 8700 is disposed closer to the exhaust paper portion side so as to decrease the tendency of the transfer papers to wind around the heating roller and to increase exhaust paper efficiency. However, it should be understood that the term "a pair of rollers" as used hereinbefore with respect to the distance of the central portion of the sensitive drum includes a construction in which, for example, the centers of the rollers are arranged on the same vertical plane. The reference numerals 8714 and 8715 respectively represent upper and lower guide plates provided for successively guiding the transfer papers P moved or carried by means of the carrying means 82, while 8716 denotes an elastic guide plate consisting of a thin member having a resilient force—formed, for example, of a polyester film.

Figure 7E:
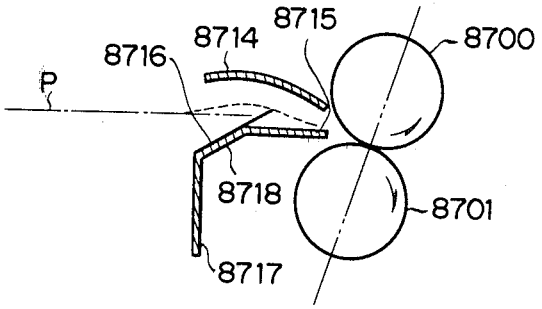
FIG. 7E shows a diagramatic arrangement of the fixing device.

A preferable shape and construction of the guide plates and the operative effect of the elastic guide plate will be explained by reference to FIG. 7E. The lower side guide plate 8715 is positioned so that its height in a horizontal direction is slightly higher than the top portion of the pressing roller 8701, and slightly lower than the carrying passage of the transfer papers. The free end of the elastic guide plate 8716 is mounted on an inclined portion 8718 formed between a mounting side of the lower guide plate—that is, a vertical portion 8717—and the lower guide plate 8715, and projecting upwardly from the lower side guide plate 8715.

In the disclosed embodiment, the elastic guide plate is stationarily mounted. However, the elastic guide plate 8716 may instead be mounted on the vertical portion 8717 by using another member so that it is capable of moving up and down.

The right side portion of the upper side guide plate 8714 is curved downwardly so that as it moves closer to the pair of rollers, it also approaches the lower side guide plate 8715. In the particular embodiment shown, the radius of the curved portion was configured as being from 20 to 35 mm. In the case where, for example, the radius of the heating roller 8700 is 20 mm, and the angle between a vertical line passing through the center of the pressing roller 8701 and a line connecting the centers of both rollers is approximately 15°, it is preferable to arrange the curved upper side guide plate 8714 so that its tip end is positioned 10 mm lower than the shaft (not shown) of the heating roller and, in addition, 2.5 mm away from the outer peripheral surface of the heating roller. The elastic guide plate assists in preventing the blur or fading phenomenon of the picture image. This can be understood by considering the construction in which the aforementioned distance between both rollers and the drum is made shorter than the length in the transferring or carrying direction of the transfer papers. When the front or tip end of the transfer paper is nipped by both rollers, and the rear end thereof is concurrently electrically sucked to the drum 13, so long as the linear speeds of the moveable or rotatable members which influence the transfer of the transfer papers are the same, no problem will arise. But it is more likely that a phase lag between the drum and the transfer paper being sucked to the drum will be produced and, as a result, fading or blurring in the picture image is liable to be created. Consequently, by using the electric guide plate 8716 and providing a slackness to the transfer paper, any difference in the carrying speeds is absorbed and a copy picture image without fading in color can be obtained. It is, in fact, desirable to set the surface speed of the pair of rollers slightly slow with respect to the surface speed of the sensitive drum.

II. The Driving system

Figure 8:
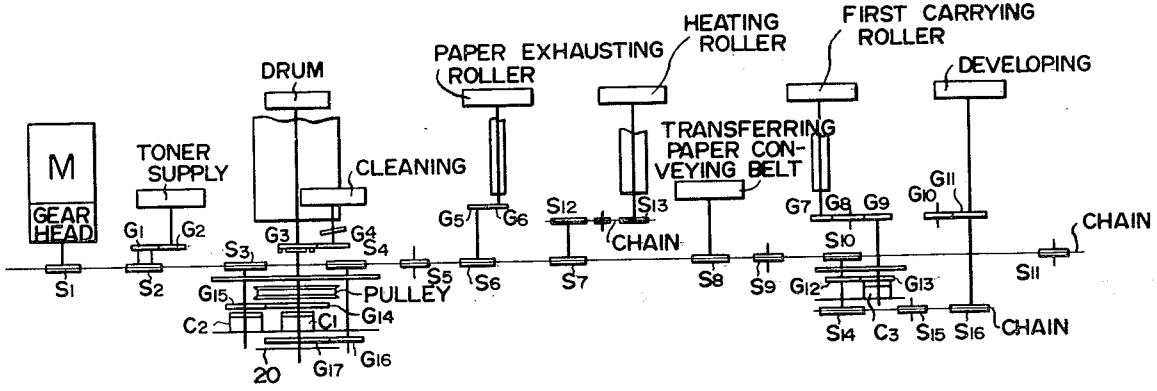
FIG. 8 shows an elongated driving system.
Figure 9:
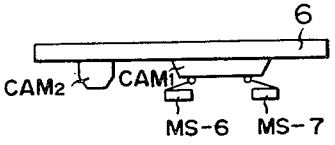
FIG. 9 shows the relation between the detecting means and the copy board.

Next, the driving system is explained by utilizing FIG. 8. In the drawing, reference symbols $S_1$ through $S_{16}$ represent sprockets, and reference symbols $G_1$ through $G_{16}$ represent gears. These members are, however, referred to by other numerals in other figures of the Drawing.

It is assumed hereinafter that the main switch is in its ON condition. When the printing button (only the region of which is shown in FIG. 1) is pushed, the main motor M is energized and a driving force is transmitted to sprocket $S_1$ via gear heads and a shaft. Accordingly, chains rotate and all of the sprockets commence their respective rotations. Describing from the left hand side of FIG. 8, gears $G_1$ and $G_2$ rotate according to the rotation of the sprocket $S_2$. The gears $G_1$ and $G_2$ are provided in association with the toner supply device. However, so long as a signal is not sent to the solenoid SOL-1, toner supply is not carried out. According to the rotation of the sprocket $S_4$, the drum shaft carrying the sensitive drum 13 is rotated via gear $G_{16}$ and gear $G_{17}$. In this case, the cleaning blade is slid or moved via gears $G_3$ and $G_4$. The rotation of the drum is transmitted to the phase detecting disc 20 arranged to rotate together with the drum.

An input to a clutch in accordance with the counted number of slits is controlled by the microcomputer. Thus, at this time, a clutch $c_1$ is operated, and a pulley holding a wire fixed at both its ends to the copy board 6 commences a reciprocal motion or movement.

In accordance with the rotation of the sprockets $S_6$, the exhaust paper roller 99 is rotated via gears $G_5$ and $G_6$. In addition, rotation of the sprockets $S_7$ builds up heating and rotation of the pressing roller. At this time, the two rollers normally maintained in a separated condition make contact with each other as previously described. The sprocket $S_8$ causes rotation of a belt B comprising a carrying means. The sprocket $S_{10}$ rotates gears $G_{12}$ and $G_{13}$; however, gear $G_{13}$ rotates only on its shaft which is not itself rotated. When an input signal of a clutch $c_3$ is entered at a controlled time, the first carrying roller 80 rotates via gears $G_9$, $G_8$ and $G_7$. On the other hand, the transmission of power to the sprockets $S_{14}$, $S_{15}$ and $S_{17}$ energizes the developing device 39. When the copy board is moved a predetermined distance according to the control of the microcomputer, the clutch $c_1$ is deenergized, while a clutch $c_2$ for reciprocating the copy board 6 is deenergized, and its power inversely rotates the pulley via gears $G_{15}$ and $G_{14}$.

III. Time Chart

Figure 10:
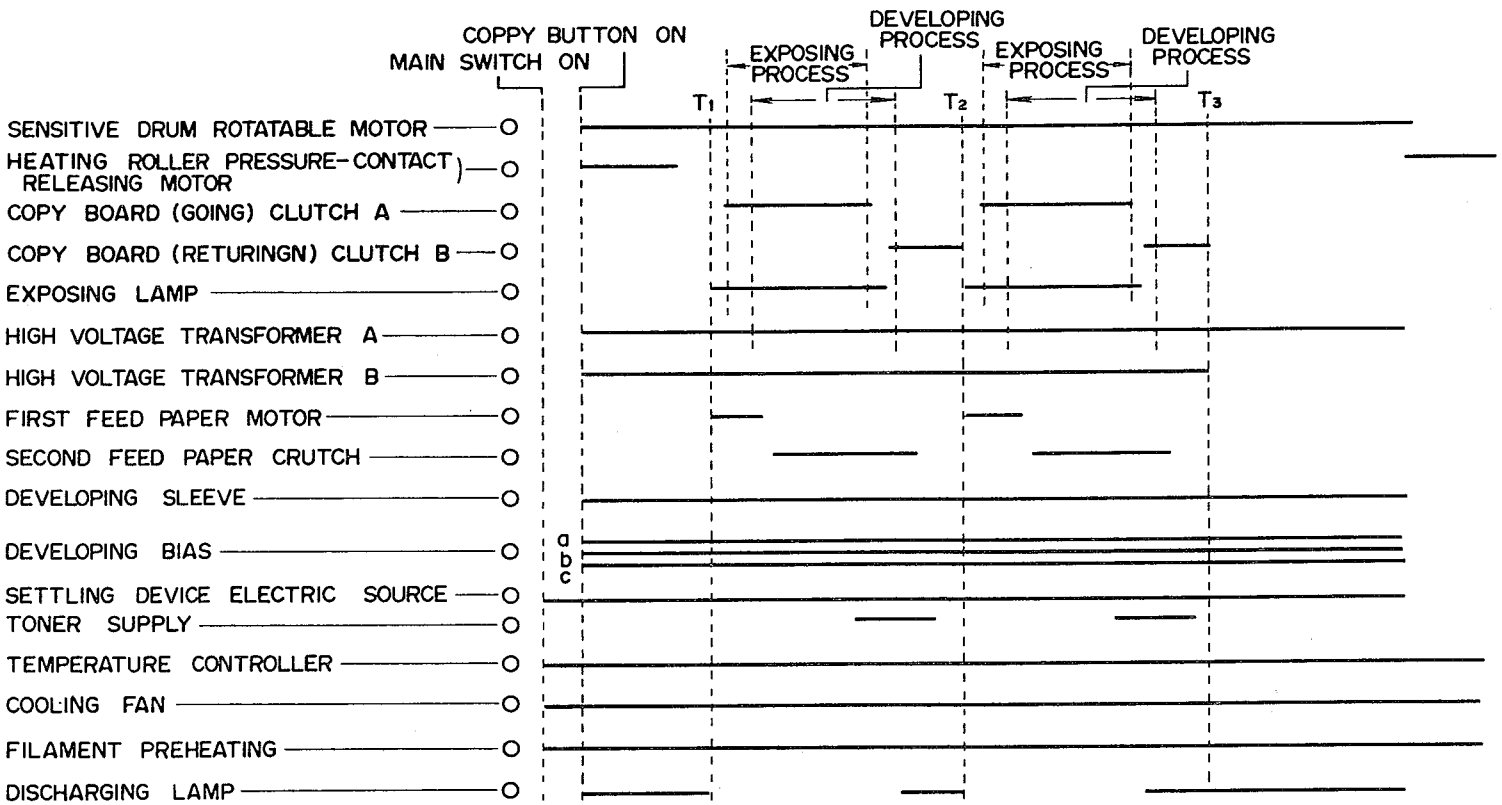
FIG. 10 shows a timing chart for the apparatus according to the present invention.

FIG. 10 is a so-called time chart showing the timing relationships of the various portions of the apparatus.

We claim:

1. In a transfer type electrophotographic copying apparatus having a copy board for supporting an original to be copied, an optical system, an exposure source for illuminating the original, a rotatable photosensitive drum, means for relatively moving the copy board and optical system to project an image of the original on the drum and thereby form on the drum an electrical charge particle pattern corresponding to the projected image of the original, toner means for converting the electrical charge particle pattern into a visible toner image on the drum, means for moving a transfer paper along a path including a position of contact with the drum, transfer electrode means disposed at said contact position for forming an electric field between the transfer electrode means and the drum such that the toner image is transferred to the transfer paper as the paper moves through said drum contact position of said path of movement, and means for heating the transfer paper after leaving said drum contact position so as to melt the toner image on the paper and thereby fix the image thereon, the improvement comprising:

said rotatable photosensitive drum having a seamless photosensitive layer about its peripheral surface, and said heating means comprising at least a rotatable heating roller containing a heating element, and a pressure-contact roller rotatable in a condition of pressure-contact with the heating roller, said transfer paper being moved along said path into pressure-contact relation between said rollers, the distance from said contact position of the transfer paper with the drum to the pressure-contact point of said heating and pressure-contact rollers being less than the length of the transfer paper as measured in the direction of movement of the paper along said path.

2. In a transfer type electrophotographic copying apparatus according to claim 1, the path along which transfer paper is moved through the apparatus being a substantially straight line path.

3. In a transfer type electrophotographic copying apparatus according to claim 1, the means for moving a transfer paper along a path including paper carrying means for transporting transfer paper from the photosensitive drum to the heating means, said carrying means including belt means for moving transfer paper along said carrying means and suction means for facilitating said transport of transfer paper along the paper carrying means on said belt means.

4. In a transfer type electrophotographic copying apparatus according to claim 3, said paper carrying means being disposed in said apparatus relatively below the photosensitive drum.

* * * * *